US011305972B1

(12) United States Patent
Elliot et al.

(10) Patent No.: US 11,305,972 B1
(45) Date of Patent: Apr. 19, 2022

(54) VEHICLE LIFT WITH LOCALLY STORED ENERGY SOURCE

(71) Applicant: Vehicle Service Group, LLC, Madison, IN (US)

(72) Inventors: Robert W. Elliot, Madison, IN (US); Michael A. Swartz, Madison, IN (US); Jason E. Matthews, Madison, IN (US); Douglas J. Brown, Madison, IN (US); Brian E. Kelley, Madison, IN (US)

(73) Assignee: VEHCILE SERVICE GROUP, LLC, Madison, IN (US)

( * ) Notice: Subject to any disclaimer, the term of this patent is extended or adjusted under 35 U.S.C. 154(b) by 646 days.

(21) Appl. No.: 14/080,240

(22) Filed: Nov. 14, 2013

Related U.S. Application Data

(60) Provisional application No. 61/726,832, filed on Nov. 15, 2012, provisional application No. 61/558,765, filed on Nov. 11, 2011.

(51) Int. Cl.
*B66F 7/28* (2006.01)

(52) U.S. Cl.
CPC ..... *B66F 7/28* (2013.01)

(58) Field of Classification Search
CPC ..... B66F 7/28
See application file for complete search history.

(56) References Cited

U.S. PATENT DOCUMENTS 4,723,107 A * 2/1988 Schmid ..... F15B 21/14 318/139
5,354,233 A 10/1994 Mandy et al.
5,593,347 A 1/1997 Mandy et al.
5,697,471 A * 12/1997 DiMucci ..... A61G 1/0567 182/141
6,012,544 A * 1/2000 Backer ..... B66F 11/044 182/2.1
7,014,012 B2 3/2006 Baker
7,219,770 B2 5/2007 Baker
7,500,816 B2 3/2009 Berends et al.
RE41,554 E 8/2010 Baker
7,815,071 B2 10/2010 Martin et al.
7,963,505 B2 6/2011 Taylor et al.
8,083,034 B2 12/2011 Bordwell et al.
8,251,184 B2 8/2012 De Jong
8,362,721 B2 1/2013 Jylha
8,887,872 B2 11/2014 Chen et al.
2004/0007697 A1* 1/2004 Petrone ..... B66F 7/0625 254/10 B
2009/0173923 A1* 7/2009 De Jong ..... B66F 7/16 254/2 C (Continued)

FOREIGN PATENT DOCUMENTS

DE WO 2011069599 A1 * 6/2011 ..... B66F 3/25

OTHER PUBLICATIONS

Machine Translation of WO2011069599. Jun. 16, 2011. Finkbeiner, Gerhard.*

(Continued)

*Primary Examiner* — Nirvana Deonauth
(74) *Attorney, Agent, or Firm* — Frost Brown Todd LLC

(57) ABSTRACT

A vehicle lift utilizes a locally stored energy source configured to deliver energy at a high rate to a DC motor to provide a fast rise time and to replenish that energy at a lower rate over a relatively longer period of time.

34 Claims, 5 Drawing Sheets

(56) References Cited

U.S. PATENT DOCUMENTS

| | | | | |
|---|---|---|---|---|
| 2011/0037041 | A1* | 2/2011 | DeJong | B66F 3/46 254/89 R |
| 2011/0243696 | A1* | 10/2011 | DiBenedetto | B66F 9/06 414/490 |
| 2013/0001486 | A1* | 1/2013 | Finkbeiner | B66F 3/46 254/1 |
| 2013/0213744 | A1* | 8/2013 | Foley | B66F 7/0625 187/276 |

OTHER PUBLICATIONS

Machine Translation of "Vehicle Lifting Platform for lifting loads, in particular vehicles", Oct. 21, 2010 by Finkbeiner et al. (Year: 2010).*

Stertil-Koni, "Wireless Mobile Column Lifts" brochure, 4 pgs. Publication date unknown, please consider it published more than a year prior to the priority date of the application.

* cited by examiner

VEHICLE LIFT WITH LOCALLY STORED ENERGY SOURCE

This patent application claims priority to U.S. Provisional Patent Application Ser. No. 61/558,765, titled Vehicle Lift With Locally Stored Energy Source, filed on Nov. 11, 2011.

TECHNICAL FIELD

The present invention relates generally to vehicle lifts, and in particular vehicle lifts which have a fast rise speed. The invention will be specifically disclosed in connection with, but not limited to, a two post above ground vehicle lift having a DC motor, at least one battery connected to selectively drive the DC motor, and a battery charging circuit.

BACKGROUND

The speed at which a vehicle lift can raise a vehicle, i.e., rise time, is important. Once a vehicle is properly located on a vehicle lift, it is desirable to raise the vehicle to a working height as quickly as possible. A fast rise time reduces the amount of time required for a technician to prepare a vehicle for service, thereby improving productivity.

One way of powering a vehicle lift utilizes an AC power unit, e.g., an AC motor, to drive a hydraulic pump to activate the hydraulic cylinders of the lift. The time required for an AC motor to raise a loaded lift depends on the size of the AC motor and the amount of current that can be delivered to the AC motor. Typically an AC motor is powered by high voltage (e.g., 208v to 575v single and three phase) provide by the local utilities. However, the costs of the size of an AC motor, the cost of the size of the electrical service to the facility, and the cost of running the required sizable electrical lines from the electric panel to the AC motor at the vehicle lift can be substantial, particularly for facilities having a plurality of service bays. Generally, the economics limit the size of the AC motor to a size capable of delivering a rise time of at least about 50 seconds.

DC motors can provide improved rise time as a result of having higher torque characteristic than AC motors, running faster when the output requirements are low (in contrast to AC motors which run at the same speed despite the output requirements). However, DC motors still require substantial current to provide a fast rise time. DC motors driven by rectified AC current are subject to the same cost of the size of the electrical service to the facility and the cost of running the required electrical lines from the electric panel to the DC motor as are AC motors.

While it is known to use DC motors connected to a battery on portable vehicle lifts, such lifts are not designed to provide a fast rise time. Portable lifts are used to lift vehicles remote from an external power supply, eliminating the need for electrical cables to provide the power. Portable lifts are configured to maximize the number of lift cycles that can be delivered on a single battery charge, so correspondingly the rise time is low.

The present invention addresses the short comings of known battery powered DC motor lifts while providing a fast rise time.

BRIEF DESCRIPTION OF THE DRAWINGS

The accompanying drawings, which are incorporated in and constitute a part of this specification, illustrate embodiments of the invention, and, together with the general description of the invention given above, and the detailed description of the embodiments given below, serve to explain the principles of the present invention.

Figure 1:
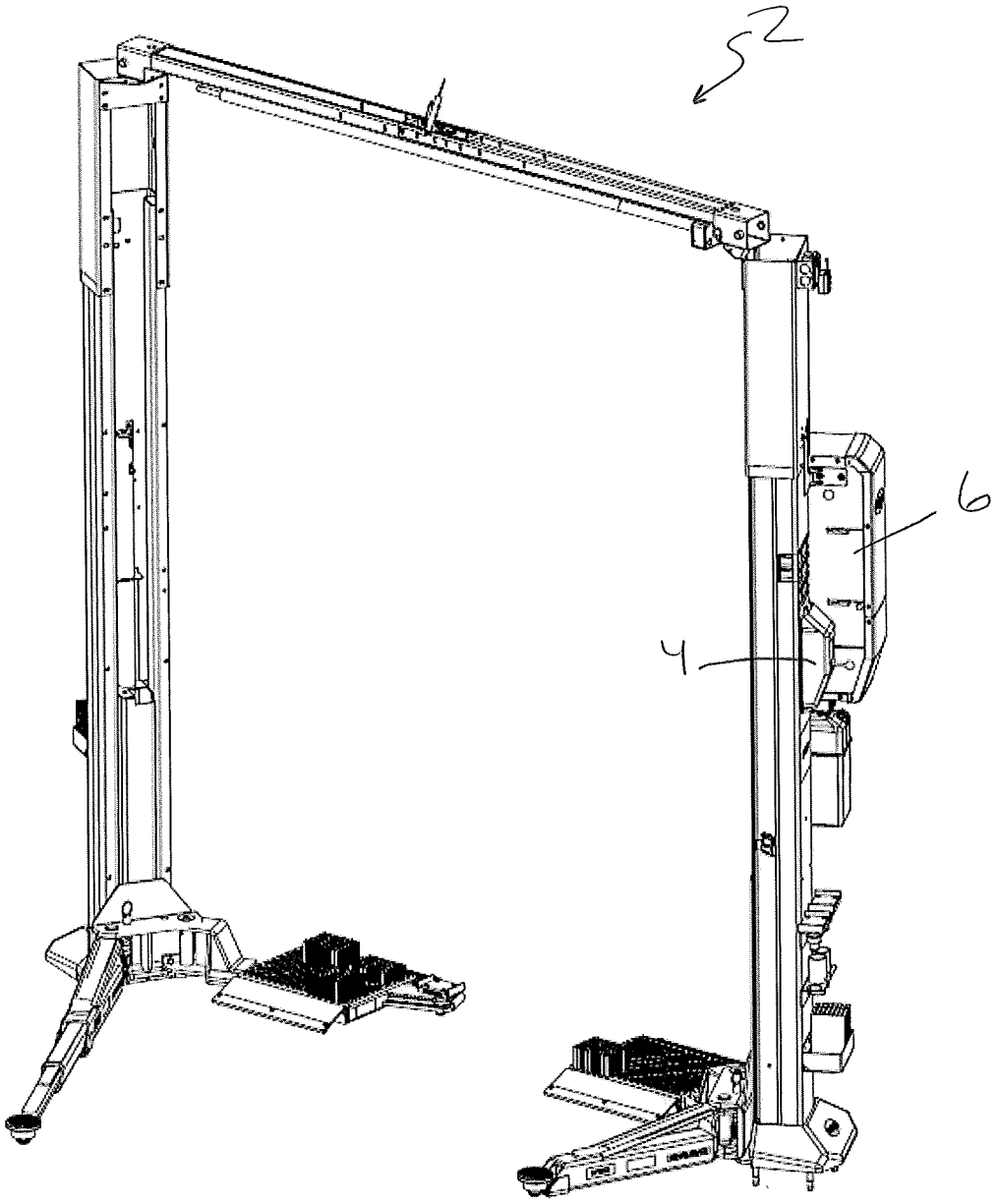
FIG. 1 is a perspective view of an above ground, asymmetric, two post lift having a DC motor.
Figure 1A:
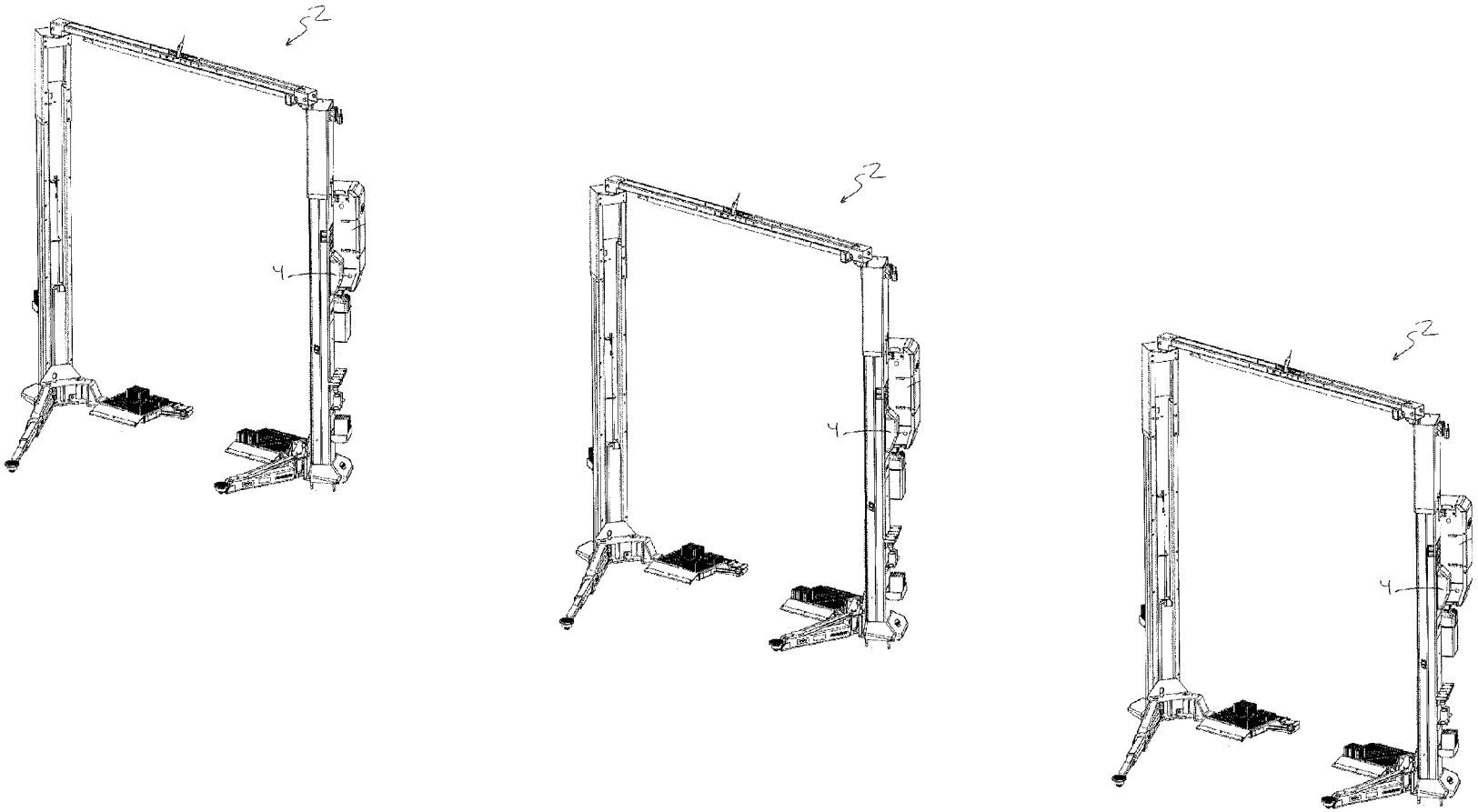
FIG. 1A is a perspective view of a plurality of spaced apart service bays comprising respective vehicle lifts.

Reference will now be made in detail to the present preferred embodiment of the invention, an example of which is illustrated in the accompanying drawings.

DETAILED DESCRIPTION

In the following description, like reference characters designate like or corresponding parts throughout the several views. Also, in the following description, it is to be understood that terms such as front, back, inside, outside, and the like are words of convenience and are not to be construed as limiting terms. Terminology used in this patent is not meant to be limiting insofar as devices described herein, or portions thereof, may be attached or utilized in other orientations. Referring in more detail to the drawings, an embodiment of the invention will now be described.

Referring to FIG. 1, there is shown a vehicle lift generally indicated at 2, permanently mounted in place in a service bay, having latch enclosure 4 and control enclosure 6. Except as described herein, lift 2 is a known prior art lift whose construction and operation is well known. Although lift 2 is depicted as an above ground, two post, asymmetric vehicle lift, the teachings of the present invention are independent of the lift configuration and may be used on any suitable lift.

Figure 2:
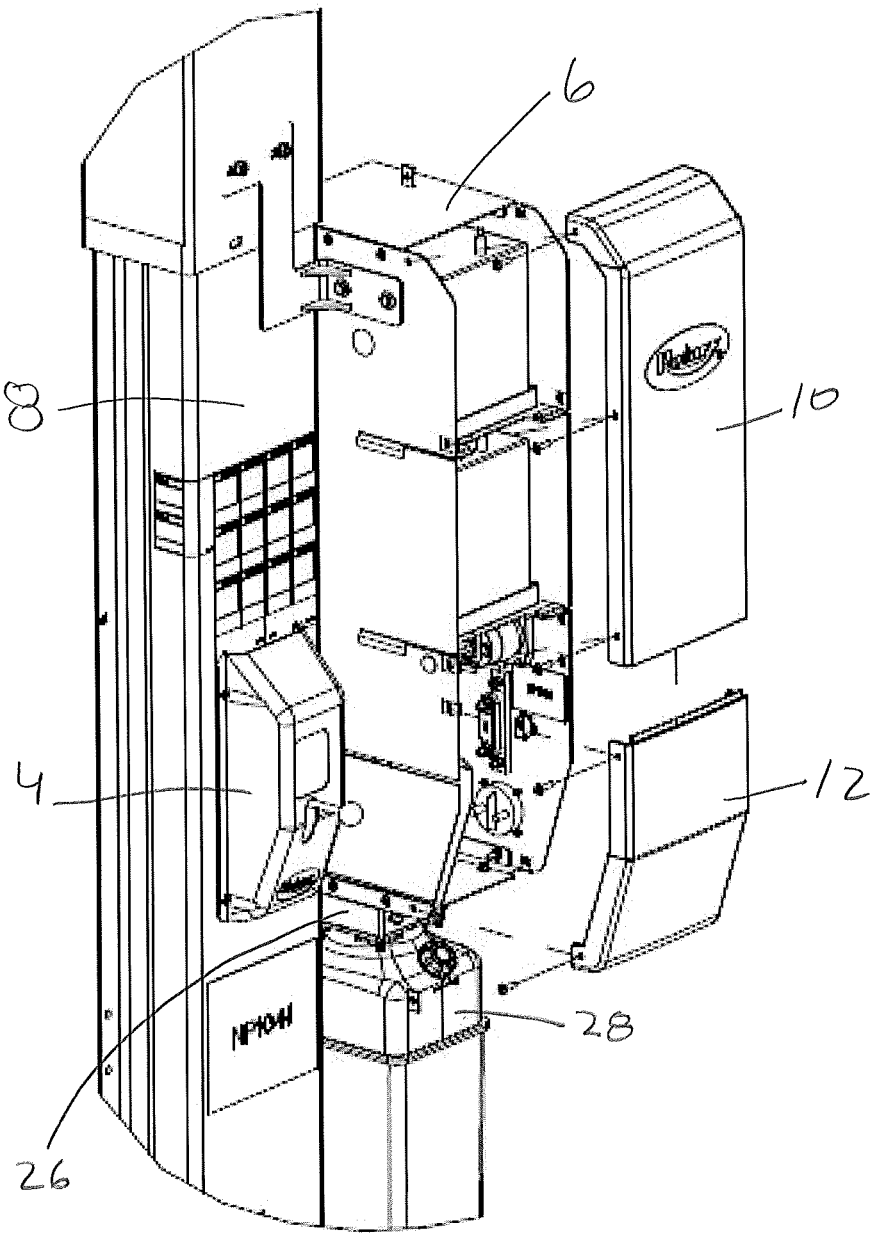
FIG. 2 is an enlarged, fragmentary perspective view of the lift of FIG. 1 showing the control enclosure.

Referring to FIG. 2, latch enclosure 4 is shown mounted to column 8 of lift 2. In the embodiment depicted, control enclosure 6 is carried by column 2, although control enclosure 6 (and its contents) may be located in any suitable location. FIG. 2 illustrates control enclosure 6 as having two covers 10 and 12, shown removed from control enclosure partially revealing the interior.

Figure 3:
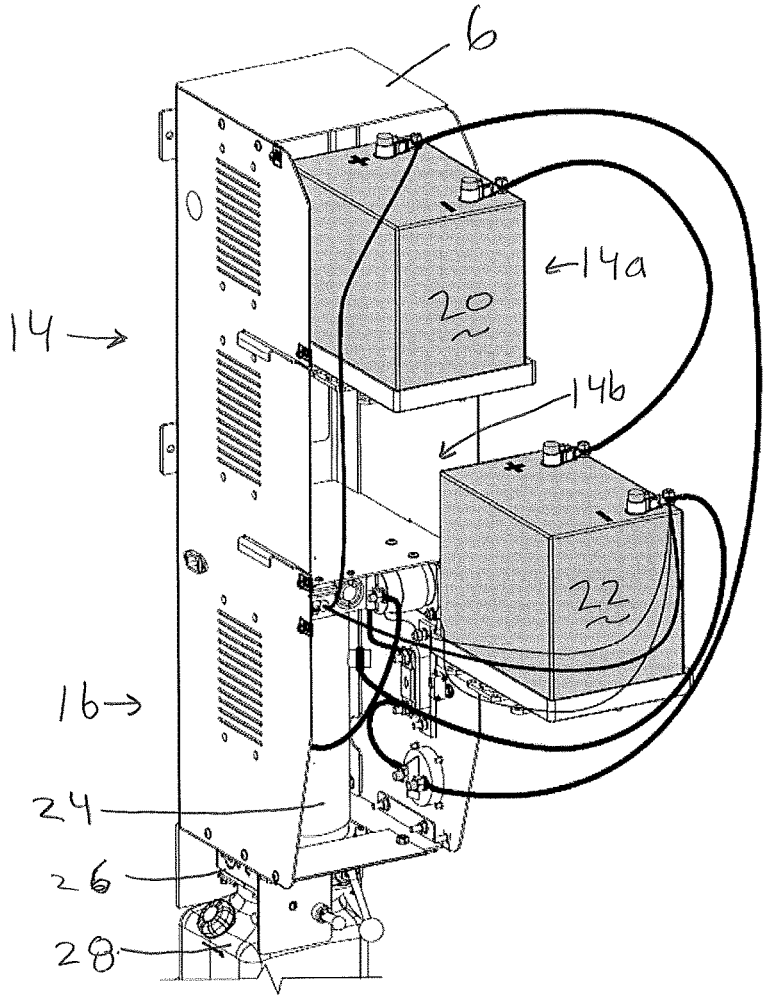
FIG. 3 is a perspective view of the control enclosure of the lift of FIG. 1.

Referring also to FIG. 3, control enclosure 6 may be of any suitable configuration and location. In the embodiment depicted, control enclosure 6 includes upper compartment 14, corresponding to cover 10, and lower compartment 16 corresponding to cover 12. Upper compartment 14 houses locally stored energy source 18 (see FIG. 4) such as batteries 20 and 22, removably disposed in subcompartments 14*a* and 14*b* allowing access to the batteries.

Lower compartment 16 houses DC motor 24 which is mechanically connected to pump 26, which in turn is connected to reservoir tank 28. Any suitable motor 24 may be used. In the embodiment depicted, motor 24 is a 24 volt, 340 max amp, 2700 RPM, 5 hp DC motor with a 14 ft-lbs torque rating. Although other locations are possible, disposing batteries 20 and 22 proximal to DC motor 24, immediately adjacent and above in the embodiment depicted, minimizes the voltage drop across cables connecting batteries 20 and 22 to DC motor 24, and minimizes work space obstruction.

Figure 4:
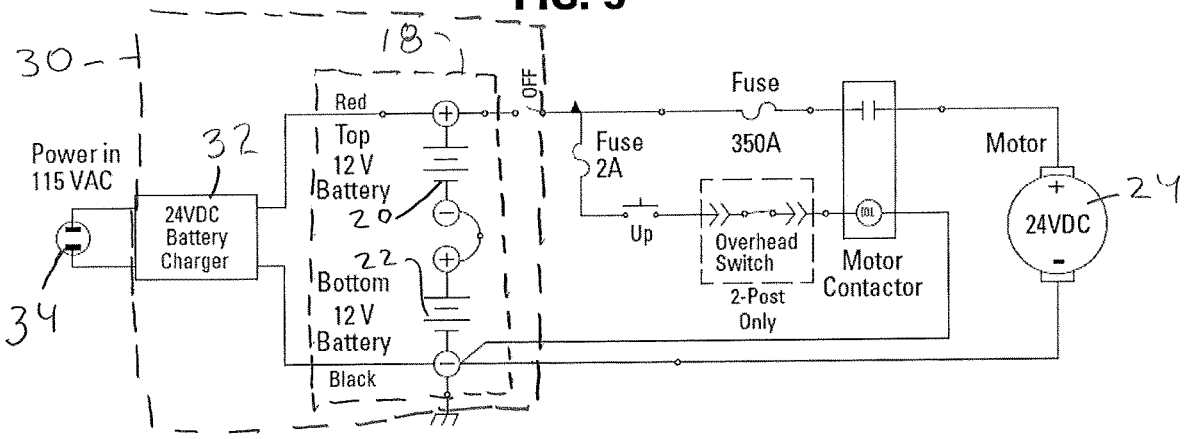
FIG. 4 is an exemplary electrical power circuit which may be used in accordance with the teachings of the present invention.

Referring to FIG. 4, exemplary electrical circuit 30 is illustrated. In the embodiment depicted, part of electrical circuit 30 is disposed in lower compartment 16, with batteries 20 and 22 disposed in upper compartment 14 as previously described. Electrical circuit 30 includes locally stored energy source 18 which may be any suitable energy source sufficient for use in accordance with the teachings of the present invention, such as batteries 20 and 22. As depicted, batteries 20 and 22 are 12 volt batteries which are connected in series, providing 24 volts to DC motor 24. Electrical circuit 30 includes means to maintain the locally stored energy level, which is depicted as charging circuit 32 connectible to an external energy source 34 In the embodiment depicted, charging circuit 32 may be configured in any suitable manner to provide the necessary charging for batteries 20 and 22.

Locally stored energy source 18 is configured to deliver sufficient energy to DC motor 24 quickly to produce a fast rise time, such as, for example, twenty seconds to thirty seconds. In the embodiment depicted, batteries 20 and 22 are Group 24 automotive batteries capable of delivering over five hundred cranking amps. Any suitable type, size and number of batteries may be used, with consideration to economics, performance. Factors include cranking amps, voltage, reserve capacity and amp hours. The amount of energy available from locally stored energy source 18 affects the rise time and the duration between cycles (raising the lift). In the embodiment depicted, with batteries 20 and 22 fully charged, several up cycles can be delivered, such as 12 cycles. Charging circuit 32 in the embodiment depicted can restore the equivalent of one lift of energy to locally stored energy source 18 in twenty minutes.

Any means may be used to maintain the locally stored energy level as is suitable. In the embodiment depicted, charging circuit 32 is configured to be continuously connected to an external power source, such as conventional 110v or 220v single phase power sources. By being configured to transfer a relatively low amount of energy to locally stored energy source 18, such as three amps, continuously over an extended period of time (relative to the rise time), the current draw from the electrical source is low and the need for high amperage electrical service may be avoided. Of course, it may be possible to configure charging circuit 32 to be periodically interrupted without departing from the teachings of the present invention, still providing sufficient restoration of energy to locally stored energy source 18.

Having a low current draw allows a single location to have multiple service bays with respective vehicle lifts constructed in accordance with the teachings of the present invention without requiring modification of the existing electrical service or the addition of high amperage service or wiring. The present invention, configured to deliver a large amount of energy to the DC motor in a short time from a locally stored energy source and to transfer energy to the locally stored energy source at a lower energy level and rate, provides a fast rise time without requiring high amperage electrical service to the lift.

Figure 5:
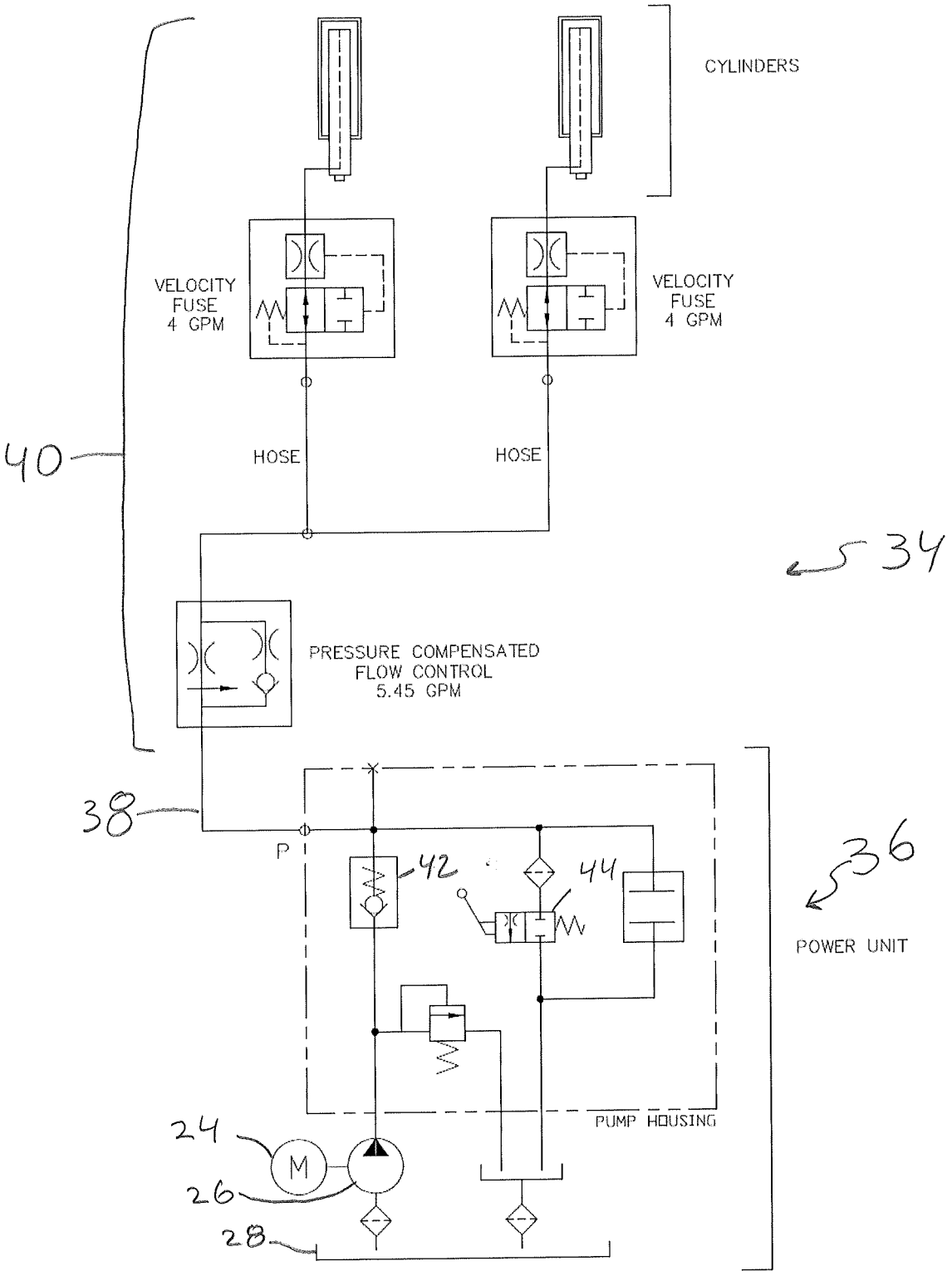
FIG. 5 is a schematic illustrating a hydraulic circuit that may be used with a two post above ground cable equalized lift in accordance with the teachings of the present invention.

Referring to FIG. 5, there is shown hydraulic circuit, generally indicated at 34, for a two post above ground lift with cable equalization. Power unit 36 of hydraulic circuit 34 provides a controlled hydraulic output 38 to the lifting circuit, generally indicated at 40, which is configured for the particular lift. Power unit 36 can be utilized with many different configurations of lifting circuit 40. When pump 26 is driven by motor 24, pressurized hydraulic fluid flows through check valve 42 to output 38. When pump 26 stops, check valve 42 prevents hydraulic fluid from flowing back toward pump 26, keeping the lift elevated (which is secured by the latch mechanism). To lower the lift, valve 44 may be moved to a position at which fluid can flow through valve 44, back to reservoir 28. It is noted that the position of valve 44 controls the rate at which fluid flows therethrough, thereby controlling the descent speed of the lift. Additionally, the position of valve 44 may be changed while the lift is being raised, such as to a position which allows a faction of the fluid flowing through check valve 42 to flow to reservoir 28 instead of flowing to output 38, thereby increasing the rise time. By controlling the position of valve 44, the rise time can be varied.

In summary, numerous benefits have been described which result from employing the concepts of the invention. The foregoing description of one or more embodiments of the invention has been presented for purposes of illustration and description. It is not intended to be exhaustive or to limit the invention to the precise form disclosed. Modifications or variations are possible in light of the above teachings. The one or more embodiments were chosen and described in order to illustrate the principles of the invention and its practical application to thereby enable one of ordinary skill in the art to utilize the invention in various embodiments and with various modifications as are suited to the particular use contemplated. It is intended that the scope of the invention be defined by the claims submitted herewith.

The invention claimed is:

1. A vehicle service system having an associated external electrical power source, said vehicle service system comprising:

a plurality of spaced apart service bays disposed at predetermined locations, each service bay comprising:

a. a respective vehicle lift, each respective vehicle lift configured to lift a respective vehicle, the respective lift comprising i. at least one moveable member configured to engage a vehicle; and ii. an electric motor operable to cause said at least one moveable member to raise;

b. a locally stored electrical energy source configured to deliver energy to said electric motor sufficient to cause said electric motor to raise said at least one moveable member through at least one lift cycle; and c. means for maintaining the locally stored electrical energy source at a desired energy level, said means comprising a charging circuit connected to said locally stored electrical energy source wherein all of the respective charging circuits are simultaneously connected to and drawing current from said external electrical power source during raising of the respective at least one moveable members.

2. The vehicle service system of claim 1, wherein said charging circuits draw electrical power from said external electrical power source at a low current draw.

3. The vehicle system of claim 1, wherein said charging circuits are connected to said external electrical power source when the respective at least one moveable members are not being raised.

4. The vehicle system of claim 1, wherein said charging circuits are configured to be periodically interrupted.

5. The vehicle service system of claim 1, wherein each respective said locally stored electrical energy source is configured to deliver energy to said respective electric motor sufficient to cause said respective electric motor to raise said respective at least one moveable member through one lift cycle in a rise time of no more than thirty seconds.

6. The vehicle service system of claim 5, wherein the rise time is no more than twenty seconds.

7. The vehicle service system of claim 1, wherein each respective said locally stored electrical energy source is disposed proximal to said respective electric motor.

8. The vehicle service system of claim 1, wherein said respective charging circuit is configured to restore the equivalent of one lift of energy to said respective locally stored electrical energy source within a period of time that is no greater than twenty minutes while drawing electrical power from said external electrical power source during said period of time at no greater than three amps.

9. A vehicle lift comprising:

a. at least one moveable member configured to engage a vehicle;

b. an electric motor operable to cause said at least one moveable member to raise;

c. a locally stored electrical energy source configured to deliver energy to said electric motor sufficient to cause said electric motor to raise said at least one moveable member through at least one lift cycle;

d. means to maintain the locally stored electrical energy source at a desired energy level, said means comprising a charging circuit connected to said locally stored electrical energy source, said charging circuit connected to and drawing electrical power from an external electrical power source, said charging circuit configured to restore the equivalent of one lift of energy to said locally stored electrical energy source within a period of time that is no greater than twenty minutes while drawing electrical power from said external electrical power source during said period of time at no greater than three amps.

10. The vehicle lift of claim 9, wherein said charging circuit is configured to be periodically interrupted.

11. The vehicle lift of claim 9, wherein said locally stored electrical energy source is configured to deliver energy to said electric motor sufficient to cause said electric motor to raise said at least one moveable member through one lift cycle in a rise time of no more than thirty seconds.

12. The vehicle lift of claim 11, wherein the rise time is no more than twenty seconds.

13. A service bay comprising a vehicle lift, said vehicle lift comprising:

a. a frame permanently mounted in place in the service bay;

b. at least one moveable member carried by said frame, said at least one moveable member configured to engage a vehicle;

c. an electric motor operable to cause said at least one moveable member to raise;

d. a locally stored electrical energy source carried by said frame and configured to deliver energy to said electric motor sufficient to cause said electric motor to raise said at least one moveable member through at least one lift cycle;

e. means to maintain the locally stored electrical energy source at a desired energy level, said means comprising a charging circuit connected to said locally stored electrical energy source, said charging circuit connected to and drawing electrical power from an external electrical power source.

14. The service bay of claim 13, wherein said charging circuit draws electrical power from said external electrical power source at a low current draw.

15. The service bay of claim 13, wherein the charging circuit is connected to and drawing current from said external electrical power source during raising of the at least one moveable member.

16. The service bay of claim 15, wherein said charging circuit is connected to said external electrical power source when the at least one moveable member is not being raised.

17. The service bay of claim 13, wherein said locally stored electrical energy source is configured to deliver energy to said electric motor sufficient to cause said electric motor to raise said at least one moveable member through one lift cycle in a rise time of no more than thirty seconds.

18. The service bay of claim 17, wherein the rise time is no more than twenty seconds.

19. The service bay of claim 13, wherein said charging circuit is configured to restore the equivalent of one lift of energy to said locally stored electrical energy source within a period of time that is no greater than twenty minutes while drawing electrical power from said external electrical power source during said period of time at no greater than three amps.

20. A vehicle service system having an associated external electrical power source, said vehicle service system comprising:

a. a plurality of respective spaced apart vehicle lifts disposed at predetermined locations, each respective vehicle lift configured to lift a respective vehicle, each respective lift comprising:

i. at least one moveable member configured to engage a vehicle; and ii. an electric motor operable to cause said at least one moveable member to raise;

b. a locally stored electrical energy source configured to deliver energy to said electric motor sufficient to cause said electric motor to raise said at least one moveable member through at least one lift cycle; and c. means for maintaining the locally stored electrical energy source at a desired energy level, said means comprising a charging circuit connected to said locally stored electrical energy source wherein all of the respective charging circuits are simultaneously connected to and drawing current from said external electrical power source during raising of the respective at least one moveable members.

21. The vehicle service system of claim 20, wherein said charging circuits draw electrical power from said external electrical power source at a low current draw.

22. The vehicle system of claim 20, wherein said charging circuits are connected to said external electrical power source when the respective at least one moveable members are not being raised.

23. The vehicle system of claim 20, wherein said charging circuits are configured to be periodically interrupted.

24. The vehicle service system of claim 20, wherein each respective said locally stored electrical energy source is configured to deliver energy to said respective electric motor sufficient to cause said respective electric motor to raise said respective at least one moveable member through one lift cycle in a rise time of no more than thirty seconds.

25. The vehicle service system of claim 24, wherein the rise time is no more than twenty seconds.

26. The vehicle service system of claim 20, wherein each respective said locally stored electrical energy source is disposed proximal to said respective electric motor.

27. The vehicle service system of claim 20, wherein said charging circuits are configured to restore the equivalent of one lift of energy to said respective locally stored electrical energy source within a period of time that is no greater than twenty minutes while drawing electrical power from said external electrical power source during said period of time at no greater than three amps.

28. A vehicle lift comprising:

a. a frame permanently mounted in place;

b. at least one moveable member carried by said frame, said at least one moveable member configured to engage a vehicle;

c. an electric motor operable to cause said at least one moveable member to raise;

d. a locally stored electrical energy source carried by said frame and configured to deliver energy to said electric motor sufficient to cause said electric motor to raise said at least one moveable member through at least one lift cycle;

e. means to maintain the locally stored electrical energy source at a desired energy level, said means comprising a charging circuit connected to said locally stored electrical energy source, said charging circuit connected to and drawing electrical power from an external electrical power source.

29. The vehicle lift of claim 28, wherein said charging circuit draws electrical power from said external electrical power source at a low current draw.

30. The vehicle lift of claim 28, wherein the charging circuit is connected to and drawing current from said external electrical power source during raising of the at least one moveable member.

31. The vehicle lift of claim 30, wherein said charging circuit is connected to said external electrical power source when the respective at least one moveable member is not being raised.

32. The vehicle lift of claim 28, wherein said locally stored electrical energy source is configured to deliver energy to said electric motor sufficient to cause said electric motor to raise said at least one moveable member through one lift cycle in a rise time of no more than thirty seconds.

33. The vehicle lift of claim 32, wherein the rise time is no more than twenty seconds.

34. The vehicle lift of claim 28, wherein said charging circuit is configured to restore the equivalent of one lift of energy to said locally stored electrical energy source within a period of time that is no greater than twenty minutes while drawing electrical power from said external electrical power source during said period of time at no greater than three amps.

* * * * *